US012357099B2

(12) United States Patent
Tar et al.

(10) Patent No.: US 12,357,099 B2
(45) Date of Patent: Jul. 15, 2025

(54) TWO-SIDED HYBRID MATTRESS TOPPER

(71) Applicant: SEALY TECHNOLOGY, LLC, Trinity, NC (US)

(72) Inventors: Kevin Tar, Summerfield, NC (US); James A. Beamon, Jamestown, NC (US); Brian M. Manuszak, Thomasville, NC (US); Allen M. Platek, Jamestown, NC (US); Alanda Tar, Summerfield, NC (US); Jessica Lee Lewis, Thomasville, NC (US); Diane Manuszak, Thomasville, NC (US)

(73) Assignee: SEALY TECHNOLOGY LLC, Trinity, NC (US)

( * ) Notice: Subject to any disclaimer, the term of this patent is extended or adjusted under 35 U.S.C. 154(b) by 139 days.

(21) Appl. No.: 17/848,950

(22) Filed: Jun. 24, 2022

(65) Prior Publication Data

US 2022/0408935 A1 Dec. 29, 2022

Related U.S. Application Data

(60) Provisional application No. 63/214,502, filed on Jun. 24, 2021.

(51) Int. Cl.
*A47C 27/05* (2006.01)
*A47C 27/15* (2006.01)

(52) U.S. Cl.
CPC ..... *A47C 27/05* (2013.01); *A47C 27/15* (2013.01)

(58) Field of Classification Search
CPC ..... A47C 27/007; A47C 27/04; A47C 27/05; A47C 27/06; A47C 27/064; A47C 27/088; A47C 27/15
See application file for complete search history.

(56) References Cited

U.S. PATENT DOCUMENTS

| | | | | |
|---|---|---|---|---|
| 6,745,420 | B2 | 6/2004 | Giori et al. | |
| 6,895,620 | B1 | 5/2005 | Rensink | |
| 10,357,113 | B2 * | 7/2019 | Gladney | A47C 27/05 |
| 10,993,543 | B2 | 5/2021 | Pennington | |
| 11,026,517 | B2 | 6/2021 | DeMoss et al. | |
| 2003/0009831 | A1 * | 1/2003 | Giori | A47C 27/18 5/709 |

(Continued)

FOREIGN PATENT DOCUMENTS

GB 2514249 A * 3/2014 ..... A47C 23/04

OTHER PUBLICATIONS

Textile World (Year: 2020).*

(Continued)

*Primary Examiner* — George Sun
(74) *Attorney, Agent, or Firm* — Stites & Harbison, PLLC; Terry L. Wright

(57) ABSTRACT

A reversible or hybrid mattress topper includes a first foam plate having a first density, a second foam plate having a second density different than the first density of the first foam plate, and a spring panel that is disposed between the first foam plate and the second foam plate. The spring panel includes a plurality of coil springs positioned between an upper fabric layer and a lower fabric layer, with the upper and lower fabric layers joined together. An insulating layer extends along an outside surface of each of the first foam plate and the second foam plate.

18 Claims, 5 Drawing Sheets

(56) References Cited

U.S. PATENT DOCUMENTS

| | | | | |
|---|---|---|---|---|
| 2006/0096032 | A1 | 5/2006 | Rensink | |
| 2016/0235212 | A1* | 8/2016 | Krtek | A47C 27/064 |
| 2016/0316927 | A1* | 11/2016 | Thomas | A47C 27/20 |
| 2016/0367038 | A1* | 12/2016 | Gladney | A47C 27/056 |
| 2019/0055115 | A1* | 2/2019 | Wolfson | B68G 9/00 |
| 2019/0343294 | A1* | 11/2019 | DeMoss | A47C 27/056 |
| 2020/0214465 | A1* | 7/2020 | Pennington | A47C 27/06 |

OTHER PUBLICATIONS

Textile World. Nanobionic: A New Sleep Technology Designed for High Performance Rest and Recovery. Nov. 9, 2020 [retrieved on Aug. 26, 2022]. Retrieved from the Internet, <URL:https://www.textileworld.com/textile-world/2020/11/introducing-sleepcharge-a-new-innovation-in-sleep-technology-designed-for-high-performance-rest-and-recovery/>.

United States Patent and Trademark Office, International Search Report and Written Opinion issued in corresponding Application No. PCT/US2022/034910, mailed Sep. 22, 2022.

European Patent Office; Extended European Search Report; Mar. 21, 2025, 8 pages.

* cited by examiner

TWO-SIDED HYBRID MATTRESS TOPPER

RELATED APPLICATIONS

This application claims priority from U.S. Provisional Application Ser. No. 63/214,502, filed Jun. 24, 2021, the entire disclosure of which is incorporated herein by this reference.

TECHNICAL FIELD

The present invention relates to a hybrid mattress topper. In particular, the present invention relates to a hybrid mattress topper that includes and/or makes use of one or more foam layers, a spring panel, and an outer shell comprised of a cover material.

BACKGROUND

The effectiveness and desirability of a support cushion is partly a function of how comfortable a user is on the support cushion over an extended period of time. In this regard, many users find support cushions, and in particular mattresses and pillows, which are made of a flexible foam to be desirable. Over the lifetime of body support cushions, such as mattresses and pillows, however, the flexible foams can lose height and firmness. The resulting loss in durability in such support cushions can then result in a decline in the comfort of the body support cushion.

Of course, it is desirable that the resilience and comfort of a body support cushion be maintained for as long as possible, and there is a continuous desire to improve the durability, comfort, and resilience of these products. Accordingly, body support cushions that allow for such an improvement in the durability, comfort, and resilience, and which allow such features to be maintained over an extended period of time would be both highly desirable and beneficial.

SUMMARY

The present invention includes a hybrid body support cushion, such as a mattress topper. In some embodiments, the hybrid mattress topper comprises both spring and foam portions to form the support, with additional layers or structures to provide a desired feel for an end user, such as a firmer or softer feel or other characteristics.

In one exemplary embodiment of the present invention, a reversible hybrid mattress topper is provided that includes a first foam plate having a first density and a second foam plate having a second density different than the first density of the first foam plate. A spring panel is then disposed between the first foam plate and the second foam plate, with the spring panel including a plurality of coil springs positioned between an upper fabric layer and a lower fabric layer. The upper and lower fabric layers are then joined together between the plurality of coil springs. An insulating layer then extends along an outside surface of each of the first foam plate and the second foam plate, and a cover is disposed about the insulating layers.

In some embodiments of such a body support cushion or mattress topper, the insulating layer comprises a fiber material, a foam, or a combination thereof. In some embodiments, the upper fabric layer or the lower fabric layer of the spring panel includes a plurality of apertures configured to allow an amount of airflow through the plurality of coil springs. In some embodiments, the upper fabric layer and the lower fabric layer of the spring panel can also be welded in a center portion of at least one of the plurality of coil springs to form a central welded portion in the at least one of the plurality of coil springs and which, in certain embodiments, further includes an opening.

With regard to the foam plates included in an exemplary mattress topper, the first foam plate, the second foam plate, or both are covered in a netting material. In some embodiments, the first foam plate, the second foam plate, or both are comprised of a polyurethane foam or a latex foam, such as, in certain embodiments, a viscoelastic foam. In some embodiments, the first foam plate, the second foam plate, or both include a plurality of airflow apertures and/or are coated with a nanobionic material.

Further provided, in some embodiments, is a two-sided hybrid mattress topper that comprises a first foam plate and a second foam plate. The first foam plate, in this other embodiment, has a density greater than that of the second foam plate, and the first foam plate further has a feel that is different than the second foam plate. A spring panel is then disposed between the first foam plate and the second foam plate, with the spring panel including a plurality of coil springs positioned between an upper fabric layer and a lower fabric layer. The upper and lower fabric layers are then joined together between the plurality of coil springs to form a coil pocket around each of the plurality of coil springs. The upper fabric layer or the lower fabric layer also includes a plurality of apertures configured to allow an amount of airflow through the plurality of coil springs. An insulating layer extends along an outside surface of each of the first foam plate and the second foam plate, and a cover is disposed about the insulating layers.

In some embodiments of such a two-sided hybrid mattress topper, the upper fabric layer and the lower fabric layer of the spring panel are constructed of a substantially air impermeable fabric, but with the upper fabric layer and the lower fabric layer of the spring panel also including air permeable regions.

Further features and advantages of the present invention will become evident to those of ordinary skill in the art after a study of the description, figures, and non-limiting examples in this document.

DESCRIPTION OF EXEMPLARY EMBODIMENTS

The present invention includes a hybrid body support cushion, such as a mattress topper. In some embodiments, the hybrid mattress topper comprises both spring and foam portions to form the support, with additional layers or structures to provide a desired feel for an end user, such as a firmer or softer feel or other characteristics. In this regard, in some embodiments and as described herein with reference to FIGS. 1-5C, a hybrid mattress topper is provided that utilizes a pair of flexible foam plates in combination with a spring panel formed of a plurality of coils, such that the characteristics of those varying layers can be tuned to meet the desires of a particular user. In some embodiments, a hybrid mattress topper can thus be provided in the form of a two-sided embodiment such that one side can be used to accommodate a user that prefers a firmer feel while the other side of mattress topper can be used by users that desire a softer feel.

Figure 1:
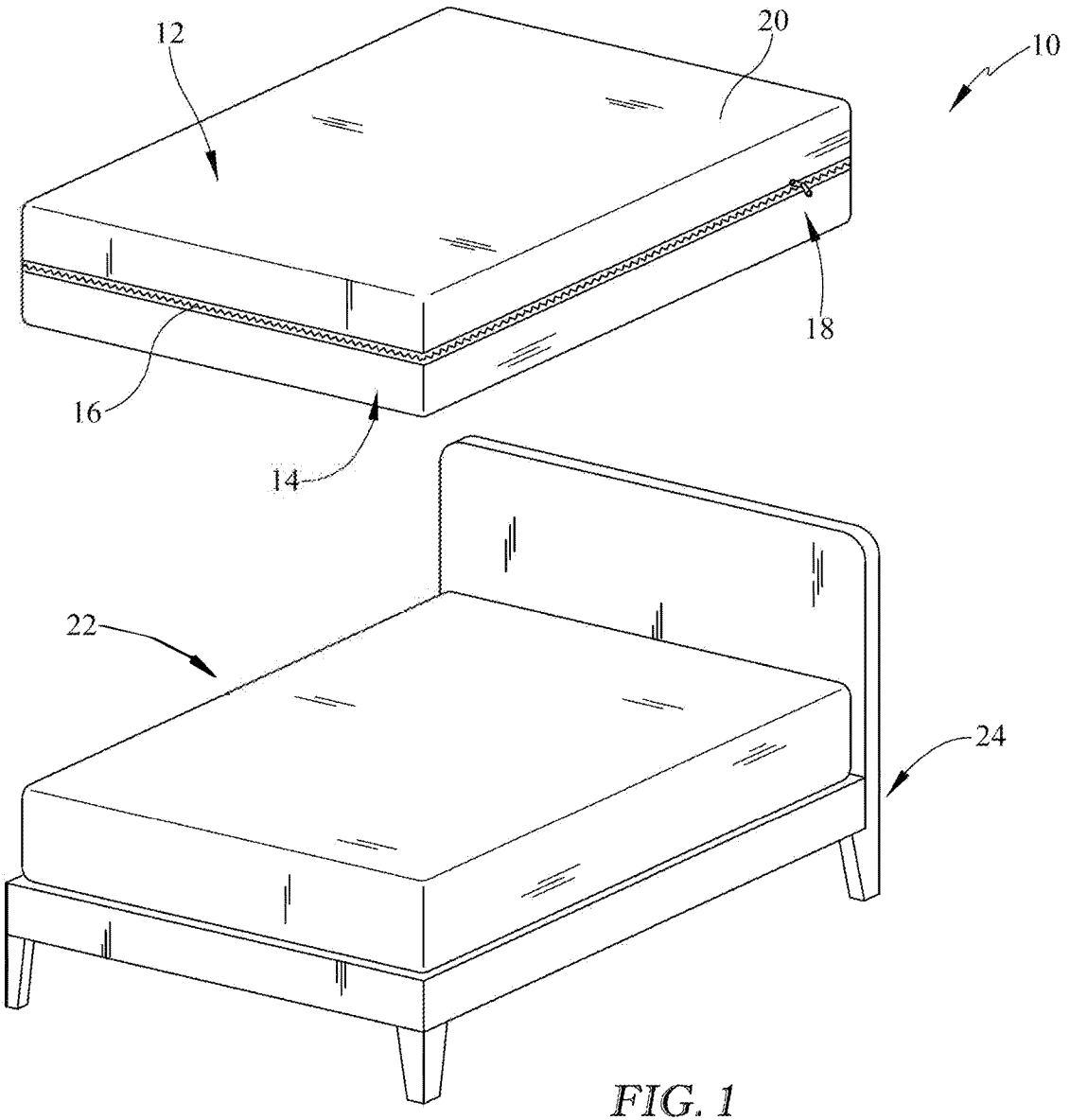
FIG. 1 is a perspective view of a hybrid mattress topper made in accordance with the present invention, and showing the hybrid mattress topper positioned above a mattress and a bedframe.

Referring first to FIG. 1, in one exemplary embodiment of the present invention, a body support cushion in the form of a mattress topper 10 is provided and is shown positioned above a mattress 22 and a bedframe 24. The mattress topper 10 has a generally rectangular peripheral shape with a generally flat upper surface 12 and a generally flat lower surface 14. The mattress topper 10 further includes a cover 20 that extends around and covers the mattress topper 10 and which is joined together at or around the peripheral edges 16 of the cover 20. In the mattress topper 10, either of the upper surface 12 or the lower surface 14 of the mattress topper 10 can be utilized by a user by flipping the mattress topper 10 from one side to the other. In this way, and as described in further detail below, in some embodiments of the invention, an exemplary mattress topper can thus be configured to provide the same feeling on both sides of the mattress topper or, in the two-sided embodiment referenced above, can be configured to provide different feelings on the two surfaces. For example, one side of an exemplary mattress topper can be configured to be firmer or softer than the other side or, alternatively or additionally, one side of an exemplary mattress topper can have the same or more/less cooling capacity than the other side.

With further regard to the mattress topper 10, to close the cover 20 around the mattress topper 10, the cover 20 further includes a closure 18 in the form of a zipper that extends along the sides of the cover 20 and, in turn, the mattress topper 10. The closure 18 allows for the opening of the cover 20 of the mattress topper 10 to thereby change the internal components of the mattress topper 10, such as, for example, when a user desires to change the internal components and characteristics of the mattress topper 10 or when a user desires to remove the cover 20 for cleaning. Of course, it is contemplated that a closure included in an exemplary mattress cover can be of various types including, but not limited to, zippers, buttons, snaps, hook and loop fasteners, and the like. Likewise, while the height, or the distance between the upper surface 12 and the lower surface 14 of the mattress topper 10 is about three to about five inches in the embodiment shown in FIG. 1, it is appreciated that this range is not exhaustive and other sizes and dimensions can also be utilized and can readily be selected depending on the desired level of comfort or on the size mattress for which it is intended (e.g. twin, full, queen, king, etc.).

Figure 2:
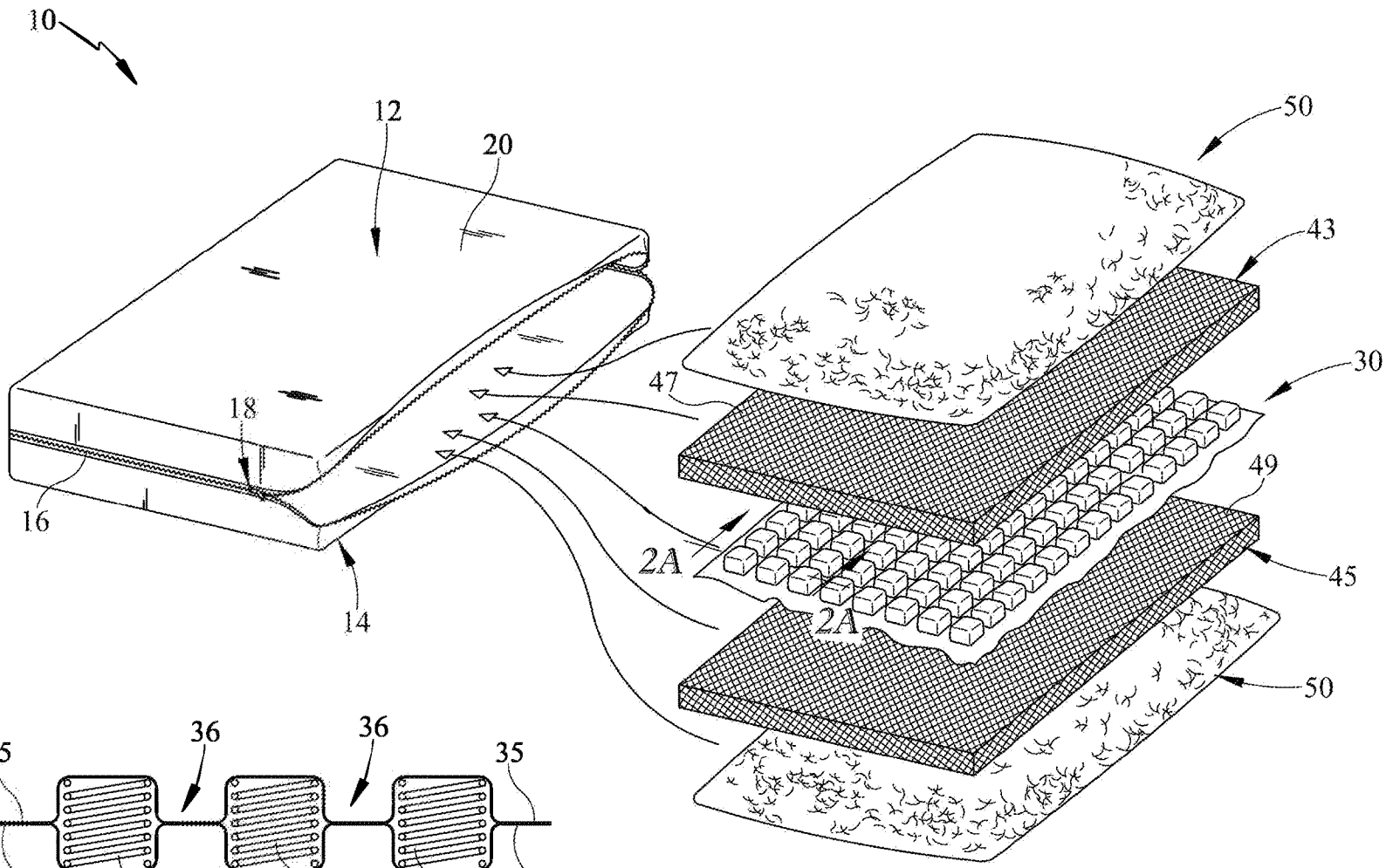
FIG. 2 is an exploded perspective view of the hybrid mattress topper of FIG. 1.
Figure 2A:
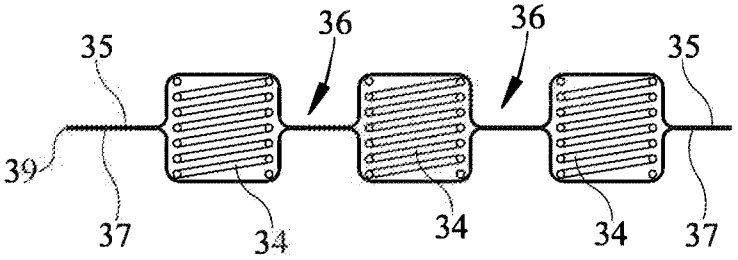
FIG. 2A is a partial sectional view of the spring panel included in the hybrid mattress topper of FIG. 1.

Referring now to FIGS. 2 and 2A, FIG. 2 shows the hybrid mattress topper 10 with the internal components of the mattress topper 10 removed from the cover 20 and in an exploded perspective view. The mattress topper 10 comprises a number of different cushioning materials and, more particularly, includes a first foam plate 43 and a second foam plate 45, with a spring panel 30 disposed between the first foam plate 43 and the second foam plate 45. The spring panel 30, which can also be referred to as a coil panel, is comprised of plurality of coil springs 34 that are laid out in an array or matrix 36 of rows and/or columns. In the depicted embodiment, the springs 34 are arranged in rows and columns that are aligned perpendicular to one another with eight of the coil springs 34 in each row and with thirteen coil springs 34 in each column. Of course, it is contemplated that the dimensions and/or number of coil springs in an exemplary mattress topper can also be offset from one another or can be otherwise varied for a particular application without departing from the spirit and scope of the subject matter described herein. Similarly, although the edges of the spring panel 30 as well as the first foam plate 43 and the second foam plate 45 appear slightly curved in FIG. 2, it is further contemplated that such edges can also be made to be substantially straight so as to provide a shape that more readily aligns with the generally rectangular shape of the cover 20 and overall mattress topper 10.

With further regard to the spring panel 30, and as perhaps best illustrated in FIG. 2A, a first fabric 35 is arranged over an upper end of each coil spring 34 and a second fabric 37 is arranged under the lower end of each coil spring 34. The fabrics 35, 37 are joined (e.g. welded) together between the coil springs 34, thereby forming not only a space between each of the coil springs 34, but also a coil pocket that surrounds each of the coils springs. The fabrics 35, 37 are then further joined together along the peripheral edges 39 of the fabrics 35, 37 to thereby define the perimeter of the spring panel 30. Each of the welds made with the fabrics 35, 37 are generally in the range of about 1 mm to about 5 mm in width so as to securely join the fabrics 35, 37 together, but can be varied as desired to provide a particular spacing or to provide coil pockets of varying sizes in order to accommodate different sizes of coil springs.

As indicated above, the fabrics 35, 37 included in the spring panel 30 are generally formed of two separate pieces of fabric that are joined together to form the spring panel 30 and surround the individual coil springs 34. An exemplary spring panel can also be formed of a single fabric folded over and joined at the open ends or with the use of additional pieces of fabric. In any instance, however, the fabrics themselves can be comprised of various materials including non-woven fabrics, warp knits, nylon, rayon, polyester, spacer fabric, or the like. In some embodiments, where a non-woven fabric is used, the non-woven fabric is free of various defects including, but not limited to, shavings, scabs, holes, and/or scraps. Additionally, in some such embodiments, where a non-woven is used, the non-woven fabric has a weight between about 40 $g/m^2$ and about 80 $g/m^2$. Further, in some embodiments, the material(s) selected for an exemplary spring panel can be used to limit air permeability such that when a spring panel is compressed, the air cannot readily escape. Likewise, when the compression force on the mattress topper is released, the expansion of the spring panel can then occur slowly due to the slow pull of air through the fabrics. Alternatively, in other embodiments, the material(s) selected for use in an exemplary spring panel can be a spun mesh lace, which can allow for increased air permeability. In some other embodiments, the fabric included in an exemplary spring panel can be air impermeable with air permeable portions located at specific locations. By controlling the size, numbers, and/or locations of the air permeable locations, the air flow into and out of the fabrics and spring panel can also be controlled. For example, each coil pocket may further include a center weld, with a hole punched through the center of the weld (see, for example, FIG. 5C, discussed below). In still further examples, it is also possible that the air permeability can be controlled through one or more welds of the fabric. In such examples, the fabric may be air impermeable or of limited air permeability. As a result, the welds may be used to control, to at least some extent, the flow of air into or out of an exemplary spring panel.

Referring still to FIGS. 2 and 2A, as noted above and in addition to the fabrics 35, 37 included in the spring panel 30, the spring panel 30 is also comprised of the plurality of coil springs 34. The coil springs included in an exemplary spring panel can be of various sizes and number within the spring panel such that the density of the coil springs included in a given spring panel can vary depending on the particular application or as desired to provide a particular feel to a mattress topper made in accordance with the present invention. Such coil springs can be up to about 3 inches in diameter and up to about 3 inches tall in a compressed height. The springs can also have an un-loaded height and a loaded height, which is shorter than the un-loaded, fully relaxed height. In the spring panel 30, the coil springs 34 included in the spring panel 30 generally have an un-loaded or coil free height of about 90 mm to about 110 mm, and a loaded or compressed height of about 27.5 mm to about 50 mm. The coil springs 34 further generally have a diameter in the range of about 55 mm to about 60 mm, and are constructed of a 17.5 gauge wire (e.g. a wire with a diameter of about 1.25 mm). The coil springs 34 are also generally turned approximately four (plus or minus a quarter turn) times to construct the coil and, when constructed, each end of the wire forming each of the coil springs 34 is typically made to reside inside the structure of the coil springs 34. To obtain the coil pocket height in each of the coil springs 34 of about 27.5 mm to about 50 mm, the coil springs 34 are generally loaded by way of engagement and joining of the two fabrics 35, 37 such that the coil springs are preloaded to about 0.7 pound-force to about 0.8 pound-force, and such that the coil springs 34 have a spring constant of about 0.2 lbs/in to about 3.0 lbs/in.

With further regard to the coil springs included in exemplary spring panel made in accordance with the present invention, it is contemplated that numerous other types and arrangements of coil springs can also be used in an exemplary spring panel without departing from the spirit and scope of the present invention. For example, in some embodiments, the coil springs can be mini-springs that, for example, have a loaded or compressed height of about 21 mm to about 25 mm, are constructed of 17.25 gauge wire or 19.5 gauge wire, and, when constructed, are arranged such that each end of the wire forming the coil of each mini spring resides within the coil spring structure. The mini springs can also be preloaded to about 0.07 pound-force to about 0.8 pound-force.

Additionally, it is further contemplated that the spring constant, regardless of the size of the spring, can be the same range, or within the same range, across the surface of an exemplary mattress topper or, alternatively, can vary in range and/or by location. Furthermore, the coil springs included in an exemplary panel can be various shapes, such as barrel, cylindrical, hourglass or the like. Pitches and diameters can also be selected as desired and can be symmetrical or non-symmetrical, which allows the coil springs to have either a linear or non-linear response when compressed. Other sizes, shapes, and variations can also be utilized, including coil-in-coil designs or designs that vary in diameter, such as a conical design and, again, can be selected for a particular application as desired and without departing from the spirit and scope of the subject matter described herein.

In some embodiments, the number of coils per square foot may be in the range of about 14 to about 250. For example, a standard queen size mattress topper can have approximately 500-600 of the coil springs 34, which can, for example, be arranged in 20 rows of 27 coil springs.

Turning now to the foam plates included in an exemplary mattress topper, various foam types can also be utilized to produce a mattress topper having a desired feel or performance characteristic. Such foams capable of use in accordance with the present invention include, but are not limited to, latex foam, reticulated or non-reticulated viscoelastic foam (sometimes referred to as memory foam or low-resilience foam), reticulated or non-reticulated non-viscoelastic foam, polyurethane high-resilience foam, expanded polymer foams (e.g., expanded ethylene vinyl acetate, polypropylene, polystyrene, or polyethylene), and the like. Further, in some embodiments, foams which are temperature responsive can be used as temperature responsiveness in a range of a user's body temperatures (or in a range of temperatures to which an exemplary mattress topper is exposed by contact or proximity to a user's body resting thereon) can provide significant advantages. As used herein, a material is considered "responsive" to temperature changes if the material exhibits a change in hardness of at least 10% measured by International Organization for Standardization (ISO) Standard 3386 through the range of temperatures between 10 and 30 degrees Celsius. In other embodiments, it may be desirable that the foam be substantially insensitive to temperature. As used herein, a material is "substantially insensitive" to temperature changes if the material exhibits a change in hardness of less than 10% measured by ISO Standard 3386 through the range of temperatures between 10 and 30 degrees Celsius.

The exemplary mattress toppers made in accordance with the present invention can be comprised of any of the various mentioned flexible foams which are capable of suitable distributing pressure from a user's body or portion thereof across the mattress topper. In the mattress topper 10, the density of the flexible foam used in the first and the second foam plates 43, 45 typically has a density sufficient for supporting the body of a user. More specifically, in the embodiment shown in FIG. 2, the first and second foam plates 43, 45 are comprised of a viscoelastic foam that has a low resilience as well as a sufficient, density and hardness, which allows pressure to be absorbed uniformly and distributed evenly across the foam plates 43, 45 of the mattress topper 10. Generally, such flexible foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the flexible foam comprising the foam plates 43, 45 has a hardness of about 10 N, about 20 N, about 30 N, about 40 N, about 50 N, about 60 N, about 70 N, or about 80 N to provide a desired degree of compression resistance and support.

The flexible foam described herein for use in the foam plates 43, 45 can also have a density that assists in providing a desired degree of compression resistance and other qualities, as well as an increased degree of material durability. In some embodiments, the density of the flexible foam used in the foam plates 43, 45 has a density of no less than about 30 $kg/m^3$ to no greater than about 150 $kg/m^3$. In some embodiments, the density of the viscoelastic foam used in the foam plates 43, 45 of the mattress topper 10 is about 30 $kg/m^3$, about 40 $kg/m^3$, about 50 $kg/m^3$, about 60 $kg/m^3$, about 70 $kg/m^3$, about 80 $kg/m^3$, about 90 $kg/m^3$, about 100 $kg/m^3$, about 110 $kg/m^3$, about 120 $kg/m^3$, about 130 $kg/m^3$, about 140 $kg/m^3$, or about 150 $kg/m^3$. Of course, the selection of a flexible foam having a particular density will affect other characteristics of the foam, including its hardness, the manner in which the foam responds to pressure, and the overall feel of the foam, but it is appreciated that a flexible foam having a desired density and hardness, as well as a particular size, weight, and shape, can readily be selected for a particular application or mattress assembly as desired and in order to provide foam plates having varying degrees of support and comfort to a user lying on an exemplary mattress assembly of the present invention. In some examples, the foam plates 43, 45 have a density of about 70 $kg/m^3$ to about 110 $kg/m^3$ and a hardness of about 25 N to about 50 N.

Further, it is also contemplated that while the foam plates 43, 45 of the mattress topper 10 are generally flat in shape, one or more surfaces of one or both of the foam plates included in an exemplary mattress topper can be comprised of other shapes or a combination of flat and other shapes. For example, in some embodiments, the top and bottom surfaces of one or both of the foam plates can be non-planar, where the top and/or bottom surfaces include ribs, bumps, grooves, dimples, or other protrusions of any shape and size, as well as apertures that may extend partially through, nearly completely, or entirely through the foam plates. Additionally, while the foam plates 43, 45 included in the mattress topper 10 are referred to herein as "plates" and are each comprised of a single continuous piece of foam, it is contemplated that one or both of the foam plates included in an exemplary mattress topper can be constructed of one or more various types of chipped foam contained within a net or other enclosure fabric or can be formed of one or more layers of foam without departing from the spirit and scope of the present invention.

Referring still to FIG. 2, although the foam plates 43, 45 are in the form of a single continuous piece of foam, each of the foam plates 43, 45 are generally covered with a netting material 47, 49 to retain the integrity of the foam plates 43, 45 and allow for a greater degree of durability. The netting material 47, 49 can be comprised of any textile in which the yarns or fibers are fused, looped or knotted at their intersections, and which result in a fabric with open spaces between the yarns or fibers. Depending on the type of yarn or filament that is used to in such a textile, it is appreciated that its characteristics can vary in durability. In some embodiments, the netting material 47, 49 may be formed of single knit jersey, double knit jersey, double rib knit, and/or can be made of fire resistant or non-fire resistant material. As a non-limiting example, non-fire resistant textiles may include, but are not limited to, untreated polyester, rayon and cotton; fire resistant textiles may include, but are not limited to, fire resistant rayon, modified acrylics, Kevlar, nomax, etc. In some embodiments, the netting material 47, 49 has a porosity of from about 50 to about 850 CFM.

Regardless of the type of netting material used to surround the foam plates 43, 45, disposed on the outer surface of the first foam plate 43 and on the outer surface of the second foam plate 45 is an insulator layer 50. In the mattress topper shown in FIG. 2, the insulator layer 50 is a fiber-based material, but it is contemplated that the insulator layer included in an exemplary assembly could be comprised of various materials having insulating characteristics, such a spacer fabric/textile material, a foam, or other material which has insulating characteristics. For example, in some instances, a spacer fabric can be used and can be formed of a bi-directionally stretched material, meaning it is stretchable in two dimensions, such as the horizontal directions, for example head to toe and laterally, side to side relative a bed. Such a spacer fabric may include a woven, or knit material, and/or may include extruded plastic materials including polyethylene, polyester, other plastics or combinations of any of these or others. In some other embodiments, and as another example, an exemplary insulator layer can be formed of a non-woven material or a high loft material. The term "non-woven" is used in the textile industry to denote fabrics which are neither woven nor knitted. Non-woven fibers are engineered fibers that are typically manufactured by putting small fibers together in the form of a sheet or web, and then bonding them together by chemical, mechanical, heat or solvent treatment. The term "non-densified" refers to fibers which have not bonded to each other through the melting and re-solidification of bonding fibers. "High-loft" is a term given to a fiber structure that contains more air than fiber. In general, high-loft fibers retain more warmth. Such high-loft material is a lofty, low-density material that is used in such applications as fiberfill, insulation, and the like. The fibers can be made of a material have a slick or slippery surface, including but not limited to polyester, polypropylene, nylon, silk, acrylic, acetate and/or rayon. In still other embodiments, an insulator layer can be comprised of natural fibers such as wool, down, or the like.

Outwardly of the insulator layer 50, and referring still to FIG. 2 is the cover 20, which is generally comprised of a fabric. Various materials may be used to form the cover including, but not limited to, cotton, cotton blends, moisture-wicking fabric, such as 100% polyester fabric, rayon, nylon, spandex-blend fabric for increased performance and stretchability, or blends or combinations of any of these materials. Such fabrics can be quilted and/or can include various designs, including but not limited to labels for a "firm" or "soft" side. The cover 20, as indicated above, also defines the outer periphery of the mattress topper 10 and, therefore, the shapes of the various layers located within the cover 20 together with the peripheral edge of the cover 20 itself define the shape of the mattress topper 10. The cover 20, and although not shown in the FIG. 2, can also comprise or be coated with nanobionic materials or other materials such as phase change materials (PCM) that may provide or enhance a cooling feel to the user.

Figure 3A:
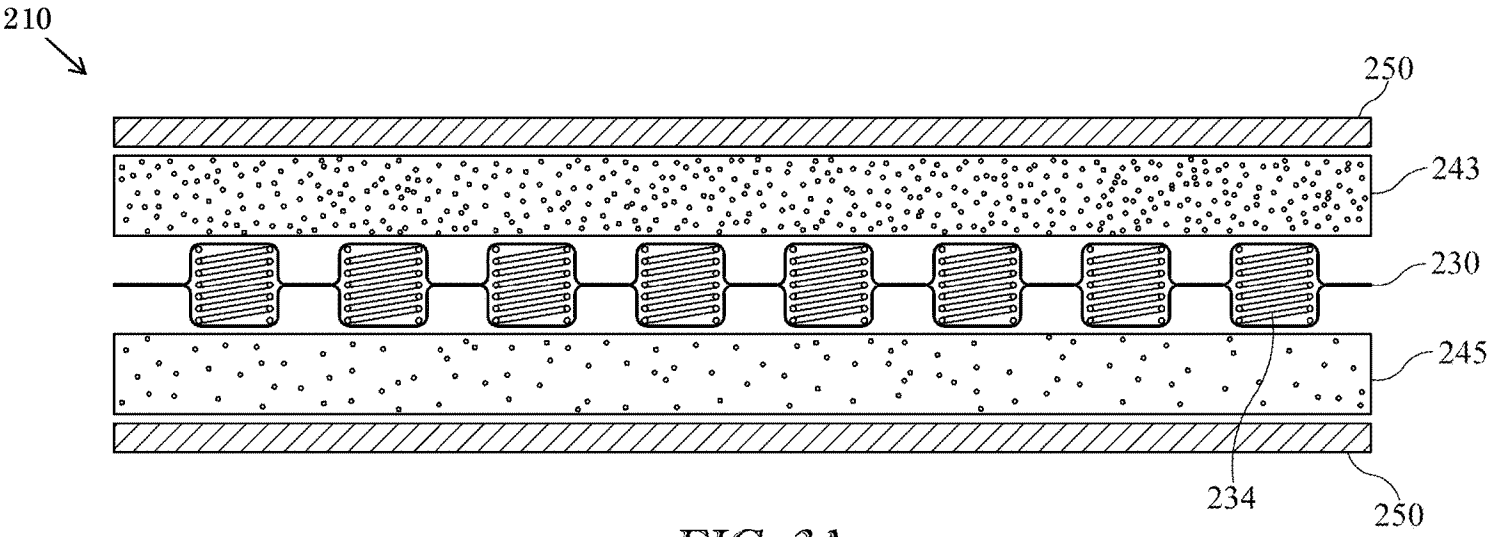
FIGS. 3A-3B are cross-sectional views of another hybrid mattress topper made in accordance with the present invention, with FIG. 3A showing the hybrid mattress topper in a first orientation, and with FIG. 3B showing the hybrid mattress topper in a second orientation.
Figure 3B:
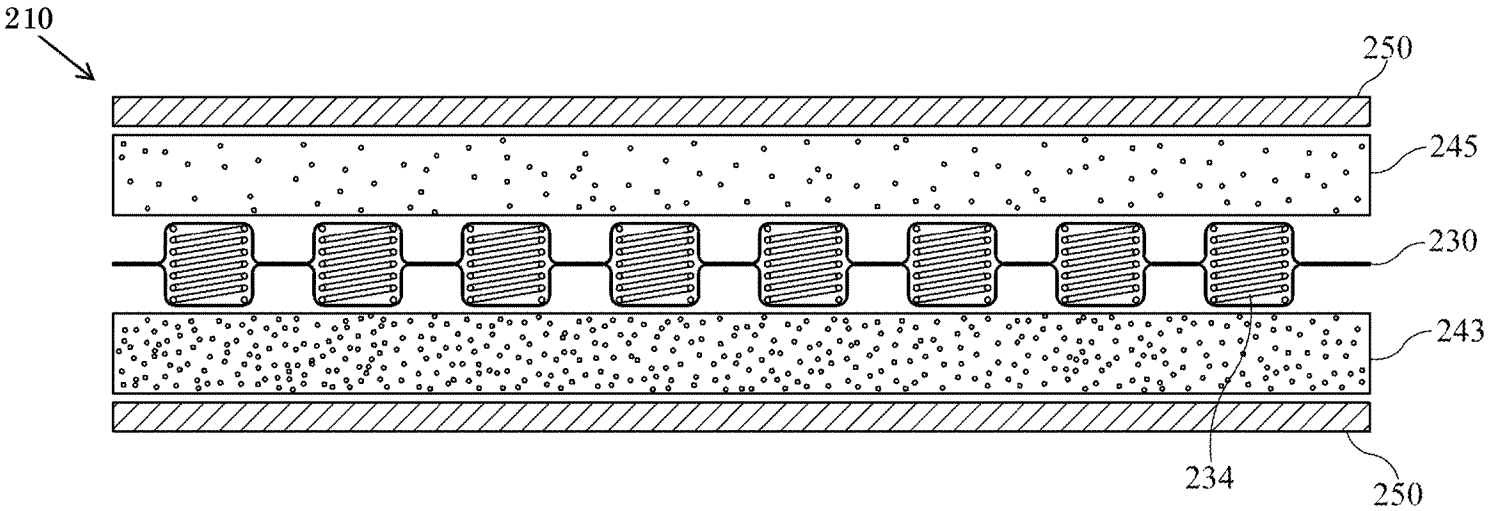

As a refinement to the mattress topper 10 described above with reference to FIGS. 1-2, in some instances, it may be desirable for the mattress topper made in accordance with the present invention to be reversible or "two-sided", such that the mattress topper exhibits a different feel for an end user depending on the orientation of the mattress topper or, in other words, depending on which side of the mattress topper is placed atop a mattress. In this regard, in some embodiments and referring now to FIGS. 3A-B, a two-sided hybrid mattress topper 210 is provided that includes various layers similar to those described with reference to FIGS. 1-2. In particular, the two-sided mattress topper 210 include a first foam plate 243, a second foam plate 245, and a spring panel 230 disposed between the first foam plate 243 and the second foam plate 245. The spring panel 230 is also formed of a matrix of coil springs 234, which are laid out in an array of rows and/or columns. Furthermore, the two-sided mattress topper 200 similarly include an insulator layer 250 adjacent to the outward surface of each of the first foam plate 243 and the second foam plate 245. In the mattress topper 210, however, the first foam plate 243 is comprised of dense foam, while the second foam plate 245 is comprised of a less dense foam. In this way, and as shown in FIG. 3A, the first foam plate 243 can be oriented upward in some instances such that the first foam plate 243 faces the user, and such that the upwardly-oriented, more dense foam plate 243 then provides a more firm feeling to the user when the user lays upon the mattress topper 210. Conversely, and as shown in FIG. 3B, the mattress topper 210 can also be "flipped" such that the second foam plate 245 is oriented upward and is facing the user, and such that the less dense foam plate 245 is configured to provide a softer feeling to the user when the end user lays on the mattress topper 210. Such a two-sided mattress topper 210 thus provides both a firm feel and a softer feel within a single structure, which may, in turn, allow the user to select their most preferred feel and/or to change the feel without needing to purchase a new product.

Figure 4A:
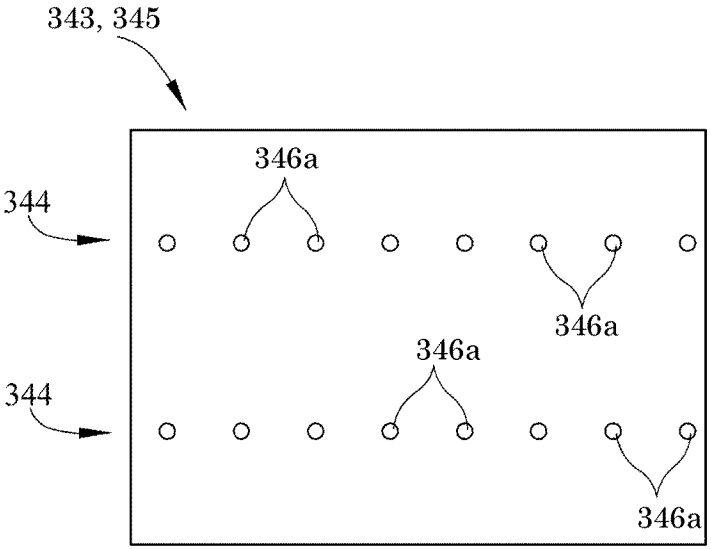
FIG. 4A is a top view of one embodiment of an exemplary foam plate included in a hybrid mattress topper of the present invention.
Figure 4B:
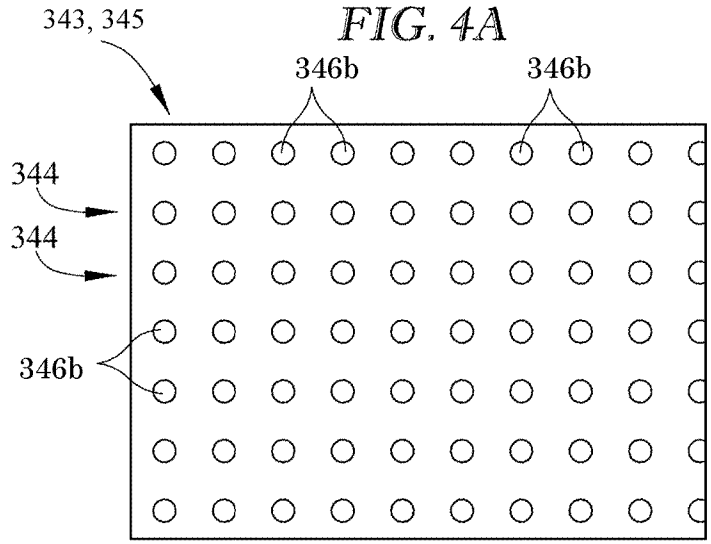
FIG. 4B is a top view of another exemplary foam plate included in a hybrid mattress topper of the present invention.
Figure 4C:
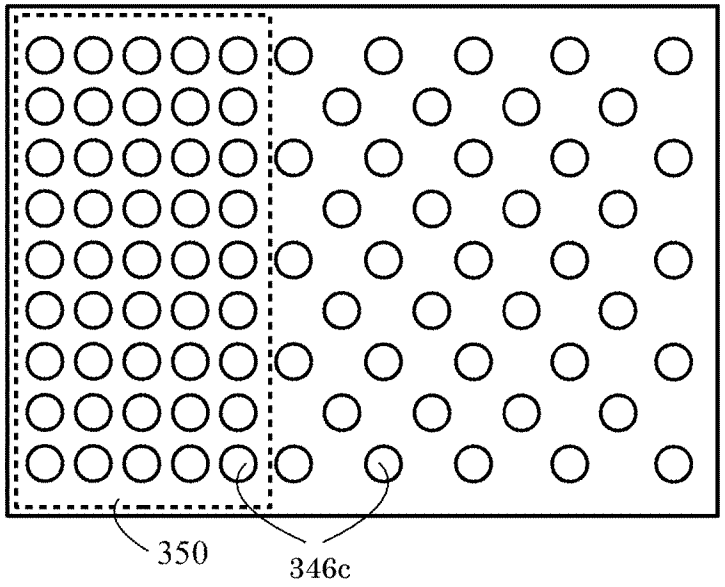
FIG. 4C is a top view of yet another exemplary foam plate included in a hybrid mattress topper of the present invention.

Referring now to FIGS. 4A-4C, and as a further refinement that alters the feel of an exemplary mattress topper made in accordance with the present invention, additional embodiments of the foam plates 343, 345 included in an exemplary mattress topper are provided. In these embodiments, the foam plates 343, 345 include a plurality of holes or apertures 345 to allow enhanced airflow and cooling within an exemplary mattress topper. The number of holes 346*a*, 346*b*, 346*c* may vary depending upon the amount of airflow desired and the characteristics of the foam. For example, in the embodiment shown in FIG. 4A, two rows 344 of apertures 346*a* are shown. However, in the embodiment of FIG. 4B, the number of rows 344 and number of apertures 346*b* are increased, which may be characteristic of the thickness and/or density of the foam comprising the foam plate 343, 345 and the amount of airflow that may otherwise move through the foam without apertures. For example, a thicker foam or a denser foam may have minimal airflow without the apertures, and thus may require more apertures than a thin or less dense foam. In this regard, it is contemplated that, in some instances, it may be desirable to provide increased airflow and, as such, the number of airflow apertures can be increased and/or the size of the airflow apertures can be increased. Alternately, if less airflow is desired, the number of apertures can be decreased.

Even further, it is also contemplated that the airflow apertures included in an exemplary foam plate can also vary in number or size by region. For example, as shown in FIG. 4C, the foam plates 343, 345 can include a higher density of airflow apertures 346*c* in a first region 350 (denoted with broken line). In some instances, this first region 350 can correspond to a foot region of the mattress, but it is appreciated that a higher concentration of apertures can also be associated with a head region, a torso region, along a perimeter and/or center of the foam plates, or so on without departing from the spirit and scope of the present invention.

The holes or apertures can also vary in shape. Although illustrated as circular-shaped apertures 346*a*, 346*b*, 346*c* in FIGS. 4A-4C, in some implementations, the apertures included in an exemplary foam plate may be round, hexagonal, octagonal, square, triangular, or any other shaped aperture or combinations thereof that allow airflow there through. Similarly, the size (e.g., the diameter) of the apertures may also vary. For example, the diameter of the apertures may vary from about ⅛ inch to about 1 inch. In some embodiments, all of the apertures of the foam plates may be the same size; while in other implementations, the apertures can vary in size or shape across the foam plates.

In addition to the inclusion of apertures, in some embodiments, additives such as copper can also be utilized to improve the characteristics of the mattress topper relative to moisture content and inhibition of mold growth. Other additives can also be included to improve the fire retardant characteristics of the foam and/or to improve the smell of the foam (e.g., carbon or charcoal additives). Moreover, far infrared radiation can be provided by an exemplary mattress topper for rejuvenating properties and/or graphite, aluminum, silver, charcoal, gel, and other additive may also be included. Still further, the foam may be coated with nanobionic materials or phase change materials (PCM). Additionally, a layer may further include biocides, preservatives, odor blocking agents, scents, pigments, dyes, stain guards, antistatic agents, anti-soiling agents, water-proofing agents, moisture wicking agents, and the like, as are known in the art.

Figure 5A:
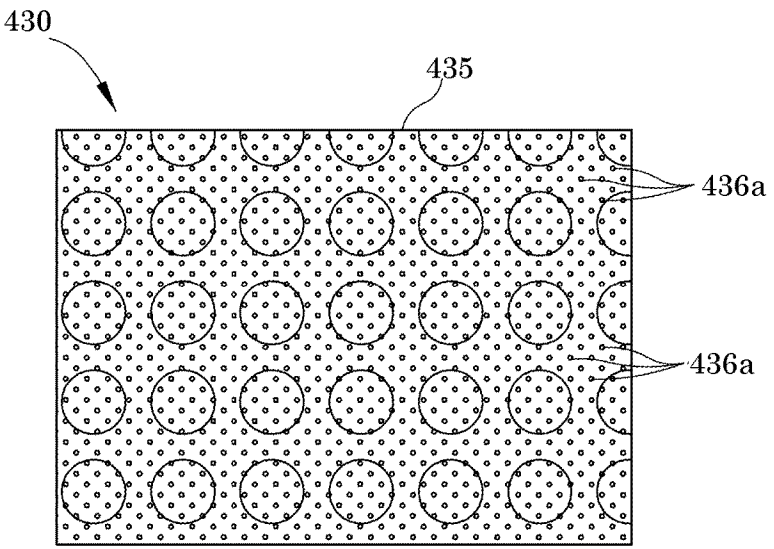
FIG. 5A is a top view of an exemplary spring panel comprising a plurality of airflow apertures and made in accordance with the present invention.
Figure 5B:
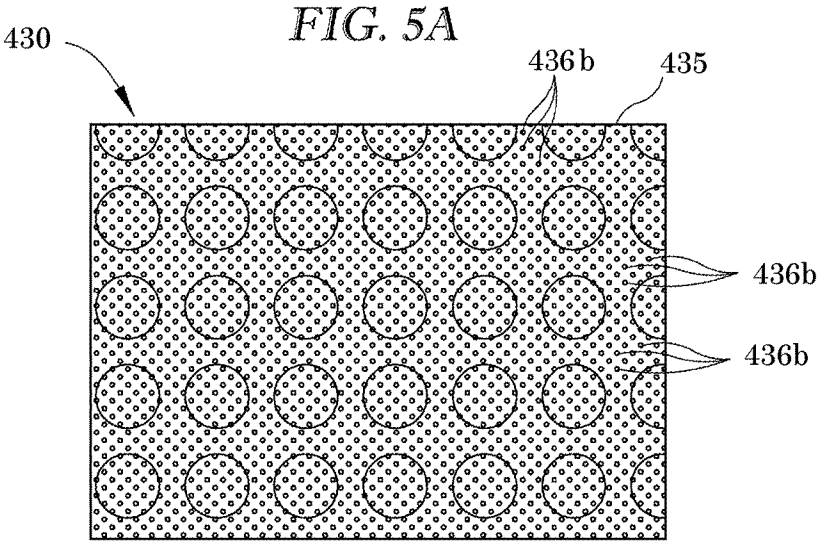
FIG. 5B is a top view of another exemplary spring panel comprising a plurality of airflow apertures and made in accordance with the present invention.
Figure 5C:
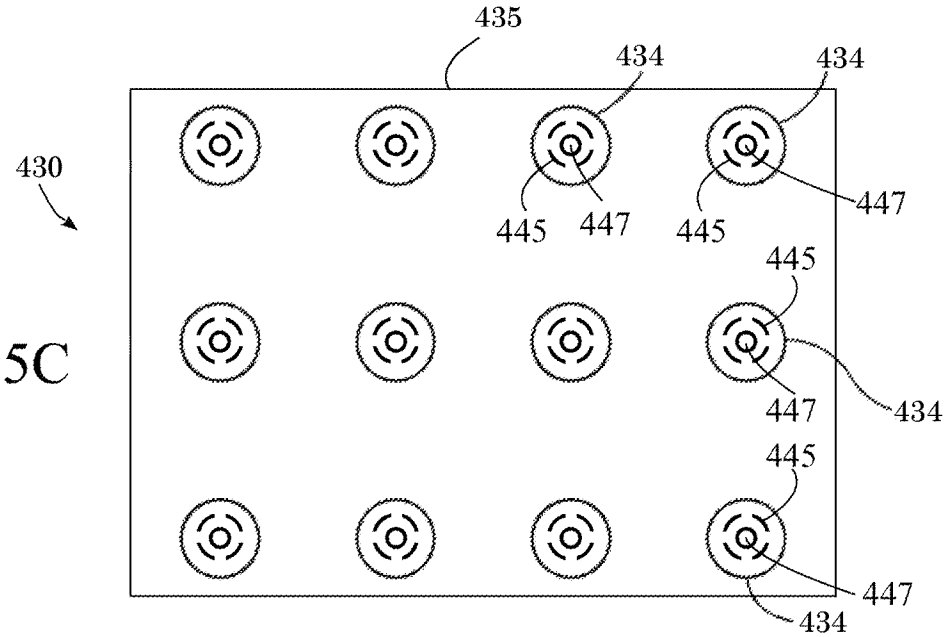
FIG. 5C is a top view of yet another exemplary spring panel comprising a plurality of airflow apertures and made in accordance with the present invention.

As a still further refinement, and with reference to FIGS. 5A-C, a spring panel 430 can also be provided that includes airflow apertures 436 to vary the amount of airflow through the coils and the spring panel 430. The first fabric and second fabrics of which only the first fabric 435 is shown in FIGS. 5A-5C can, in such embodiments, have varying densities of apertures 436 to improve the airflow through the spring panel 430. For instance, in FIG. 5A, the number of holes 436*a* is smaller per square inch than the number of holes 436*b* shown in FIG. 5B. As another example, in FIG. 5C, the first and second fabrics, again of which only the first fabric 435 is shown in FIG. 5C, can be additionally welded to a center portion of the coil springs 434. In such an embodiment, there may be center punch through or an opening 447 within this central welded portion 445 to allow for airflow (i.e. an airflow aperture). This central welded portion 445 can, in some embodiments, have a diameter of about 21 mm to about 25 mm and the center punch through may have a diameter of about 9 mm to about 10 mm.

As an even further refinement to the present invention, although the support cushions shown in FIGS. 1-5C are in the form of a mattress topper and are dimensionally-sized to support a user lying in a supine or prone position, it is contemplated that the features described herein are equally applicable to other support structures including, but not limited to, various types of supports including bedding and/or cushions for chairs and furniture, padding for medical devices and equipment (e.g., wheelchair seat pads, wheelchair padding, medical pads, hospital gurney pads, operating table pads, positioning pads), padding for furniture (e.g., upholstery padding, furniture cushions, furniture pads), padding for athletic equipment and devices (e.g., athletic cushions, sports and athletic padding, gymnastic mats), padding for recreational equipment and devices (e.g., camping and sleeping mats), padding for apparel (e.g., bra straps, shoulder pads, shoe linings, boot linings), padding for household goods (e.g., anti-fatigue mats, mattress pads, and the like); padding accessories (e.g., briefcase shoulder straps, computer carrying cases, purses, gloves, and the like), pet beds, and the like. As such, the phrase "support cushion", "body support cushion", and the like is used herein to refer to any and all such objects having any size or shape, and that are capable of or are generally used to support the body of a user or a portion thereof.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A reversible hybrid mattress topper, comprising:

a first foam plate having a first density;

a second foam plate having a second density different than the first density of the first foam plate;

a spring panel disposed between the first foam plate and the second foam plate, the spring panel including a plurality of coil springs positioned between an upper fabric layer and a lower fabric layer, and the upper and lower fabric layers joined together between the plurality of coil springs and along the peripheral edges of the upper and lower fabric layers, such that the upper and lower fabric layers form a space between each of the coil springs, form a coil pocket around each of the coil springs, and define a perimeter of the spring panel; and an insulating layer comprised of a fiber material and extending along an outside surface of each of the first foam plate and the second foam plate such that each insulating layer is positioned adjacent to an upper or a lower surface of the mattress topper.

2. The reversible hybrid mattress topper of claim 1, further comprising a cover disposed about the insulating layer.

3. The reversible hybrid mattress topper of claim 1, wherein the upper fabric layer or the lower fabric layer of the spring panel includes a plurality of apertures configured to allow an amount of airflow through the plurality of coil springs.

4. The reversible hybrid mattress topper of claim 3, wherein the upper fabric layer and the lower fabric layer of the spring panel are welded in a center portion of at least one of the plurality of coil springs to form a central welded portion in the at least one of the plurality of coil springs.

5. The reversible hybrid mattress topper of claim 4, wherein the central welded portion further includes an opening.

6. The reversible hybrid mattress topper of claim 1, wherein the first foam plate, the second foam plate, or both are covered in a netting material.

7. The reversible hybrid mattress topper of claim 1, wherein the first foam plate, the second foam plate, or both are comprised of a polyurethane foam or a latex foam.

8. The reversible hybrid mattress topper of claim 7, wherein the first foam plate, the second foam plate, or both are comprised of a viscoelastic foam.

9. The reversible hybrid mattress topper of claim 1, wherein the first foam plate, the second foam plate, or both include a plurality of airflow apertures.

10. The reversible hybrid mattress topper of claim 1, wherein the first foam plate, the second foam plate, or both are coated with a nanobionic material.

11. A two-sided hybrid mattress topper, comprising:

a first foam plate and a second foam plate, the first foam plate have a density greater than the second foam plate, and the first foam plate having a feel different than the second foam plate;

a spring panel disposed between the first foam plate and the second foam plate, the spring panel including a plurality of coil springs positioned between an upper fabric layer and a lower fabric layer, the upper and lower fabric layers joined together between the plurality of coil springs and along the peripheral edges of the upper and lower fabric layers, such that the upper and lower fabric layers form a space between each of the coil springs, form a coil pocket around each of the coil springs, and define a perimeter of the spring panel, and the upper fabric layer or the lower fabric layer including a plurality of apertures configured to allow an amount of airflow through the plurality of coil springs; and an insulating layer comprised of a fiber material and extending along an outside surface of each of the first foam plate and the second foam plate such that each insulating layer is positioned adjacent to an upper or a lower surface of the mattress topper.

12. The two-sided hybrid mattress topper of claim 11, further comprising a cover disposed about the insulating layer.

13. The two-sided hybrid mattress topper of claim 11, wherein the first foam plate, the second foam plate, or both are covered in a netting material.

14. The two-sided hybrid mattress topper of claim 11, wherein the first foam plate, the second foam plate, or both are comprised of a polyurethane foam or a latex foam.

15. The two-sided hybrid mattress topper of claim 14, wherein the first foam plate, the second foam plate, or both are comprised of a viscoelastic foam.

16. The two-sided hybrid mattress topper of claim 11, wherein the first foam plate, the second foam plate, or both are coated with a nanobionic material.

17. The two-sided hybrid mattress topper of claim 11, wherein the upper fabric layer and the lower fabric layer of the spring panel are constructed of a substantially air impermeable fabric, and wherein the upper fabric layer and the lower fabric layer of the spring panel further include air permeable regions.

18. The two-sided hybrid mattress topper of claim 17, wherein the upper fabric layer and the lower fabric layer of the spring panel are welded in a center portion of at least one of the plurality of coil springs to form a central welded portion in the at least one of the plurality of coil springs, the central welded portion further defining an opening.

* * * * *